United States Patent [19]

Stahlecker

[11] Patent Number: 4,969,323

[45] Date of Patent: Nov. 13, 1990

[54] SLIVER SPLICING ARRANGEMENT FOR A SPINNING MACHINE

[75] Inventor: Fritz Stahlecker, Bad Uberkingen, Fed. Rep. of Germany

[73] Assignee: Hans Stahlecker, Fed. Rep. of Germany; a part interest

[21] Appl. No.: 302,411

[22] Filed: Jan. 27, 1989

[30] Foreign Application Priority Data

Jan. 28, 1988 [DE] Fed. Rep. of Germany ..... 3802413

[51] Int. Cl.[5] ..... D01H 4/48; D01H 15/00

[52] U.S. Cl. ..... 57/261; 57/22; 57/90

[58] Field of Search ..... 57/261, 263, 264, 405, 57/83, 90, 22, 281; 19/0.25, 159 A, 157

[56] References Cited

U.S. PATENT DOCUMENTS

| | | | |
|---|---|---|---|
| 4,033,104 | 7/1977 | Kamp | 57/90 X |
| 4,150,534 | 4/1979 | Raasch | 57/90 X |
| 4,156,341 | 5/1979 | Raasch | 57/83 X |
| 4,653,263 | 3/1987 | Stahlecker et al. | 57/83 X |
| 4,798,045 | 1/1989 | Bottarelli et al. | 57/261 X |
| 4,838,018 | 6/1989 | Hoeber | 57/263 |

FOREIGN PATENT DOCUMENTS

| | | |
|---|---|---|
| 107952 | 8/1974 | Fed. Rep. of Germany . |
| 2646313 | 4/1978 | Fed. Rep. of Germany . |
| 3501875A | 7/1986 | Fed. Rep. of Germany . |

*Primary Examiner*—Joseph J. Hail, III

*Attorney, Agent, or Firm*—Evenson, Wands, Edwards, Lenahan & McKeown

[57] ABSTRACT

A spinning machine is disclosed which includes a sliver feeding device for introducing sliver into a spinning unit from a sliver container. To accommodate picking out the starting portion of a new sliver from a container and for connecting it with an end portion of the old sliver entering the spinning unit, apparatus is provided for picking up the new sliver and supporting the same in such a manner that the old sliver and the new sliver overlap one another in the area of the sliver supporting device adjacent the inlet area of the feeding device of the spinning unit.

28 Claims, 7 Drawing Sheets

20
2
25
21
23
16
33
3
10
45
47
49
51
15
46
11
30
4
48
50
9
7

SLIVER SPLICING ARRANGEMENT FOR A SPINNING MACHINE

BACKGROUND AND SUMMARY OF THE INVENTION

The invention relates to a spinning machine having a plurality of adjacently arranged spinning units, each containing a sliver feeding device for the withdrawal of a sliver from a container and for the introduction of the sliver into the respective spinning unit, and having devices for picking up the starting portion of a new sliver of a readied container and for connecting it with the end portion of the old sliver entering into the spinning unit.

In the case of a known spinning machine of the initially mentioned type (DE-A 35 01 875 corresponding U.S. Pat. No. 4,653,26), it is provided that either the connecting of the end portion of the old sliver with the starting portion of the new sliver takes place such that approximately the same number of fibers exist in the connecting point, or that, before a piecing, the sliver feeding device first remains switched on until the connection point between the slivers has entered into the spinning unit, the fibers which are fed to the spinning point not being used for the spinning process but being removed as waste.

It is also known (DD-PS 107 952) to feed the sliver to a fine-spinning machine in large containers which, at the fine-spinning machine, are transferred to smaller containers circulating on a conveying device. The sliver will then enter into the spinning units from the smaller containers. Two of these smaller containers, so-called spinning cans, are assigned to each spinning unit, these spinning cans being arranged above one another. The end portion of the sliver of the just-serviced spinning can is connected with the starting portion of the sliver of the spinning can which is located in the supply position or of the new spinning can which is brought into the supply position, so that a continuous feeding of the sliver is possible.

It is also known (DE-C 26 46 313) to first completely use up the sliver in the respective spinning units and, as a result, generate a signal by means of which a supply of a container with a new sliver is triggered and possibly an automatic threading of the starting portion of the new sliver into the respective spinning unit.

An object of the invention is to further improve a spinning machine of the initially mentioned type by facilitating the connecting of the old and the new sliver.

This object is achieved in that each spinning unit, in an inlet area, is equipped with devices for supporting the entering sliver, and in that the devices for picking-up the starting portion of the new sliver can be applied to the devices for the supporting in such a manner that the old sliver and the new sliver overlap one another in this area of support.

This development provides the possibility that the slivers to be connected with one another can be pressed against one another, while they are located in a certain, specified position. This facilitates the connecting of the sliver sections.

Other objects, advantages and novel features of the present invention will become apparent from the following detailed description of the invention when considered in conjunction with the accompanying drawings.

DETAILED DESCRIPTION OF THE DRAWINGS

Figure 1:
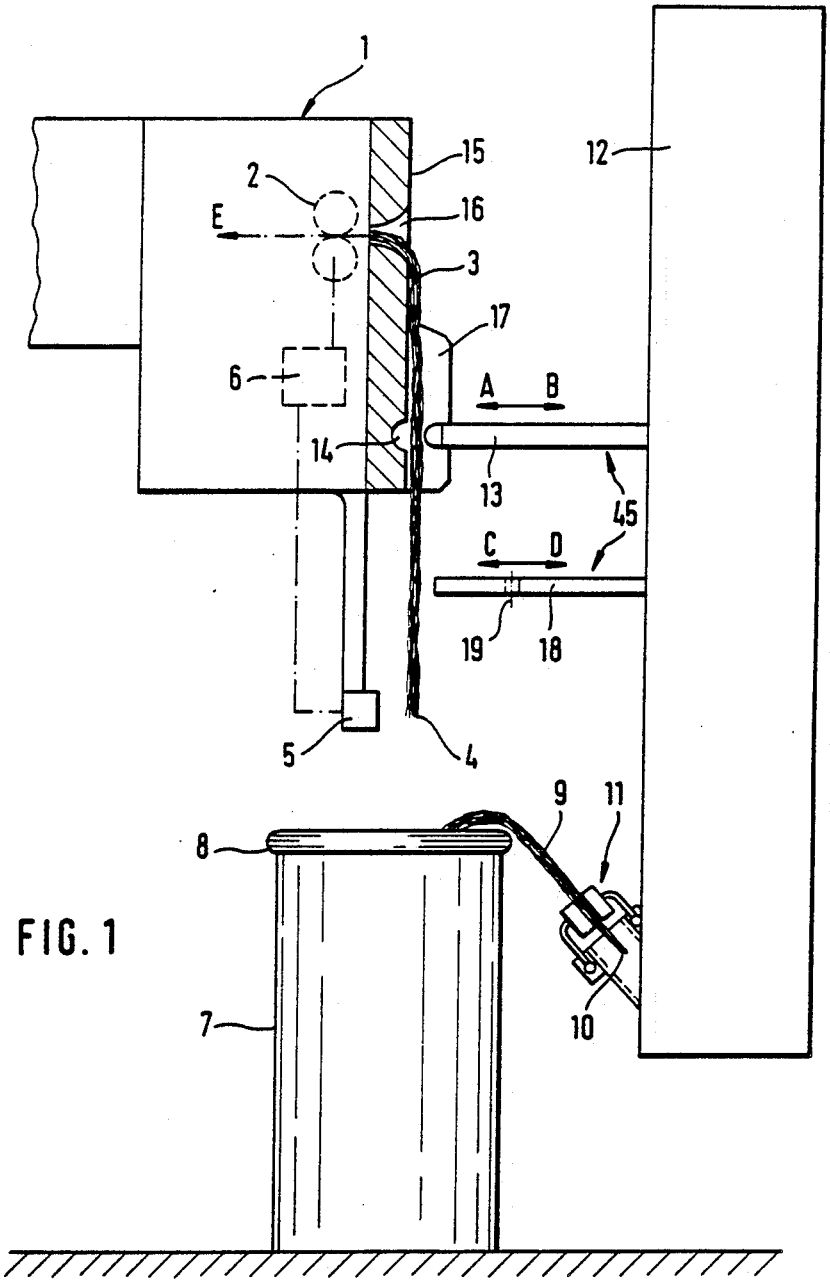
FIG. 1 is a lateral view of a schematically represented spinning machine and of a servicing apparatus shown shortly before the feeding of a new sliver constructed in accordance with a preferred embodiment of the invention.

FIG. 1 contains a very simplified view of an individual spinning unit 1 of a spinning machine which is composed of a plurality of identical spinning units 1 arranged in a row next to one another. Each of these spinning points 1 contains a sliver feeding device 2 by means of which a sliver 3 is withdrawn from a container and is introduced into the spinning point 1 in the direction of the Arrow E. The feeding device is shown also only very schematically. It may be a feeding device for an open-end spinning unit which normally is formed by a feeding roller and a feeding table for an open-end spinning unit or a pair of intake rollers of a drafting unit or the like.

A device 6, by means of which the sliver supply can be interrupted, is assigned to the sliver feeding device 2. It may be a drive or also a coupling which are switched correspondingly. A detector 5 is assigned to the device 6 which responds to the end portion 4 of the entering sliver 3 and, by means of the device 6, stops the sliver feeding device 2 in such a manner that the end portion 4 of the sliver 3 does not completely enter into the spinning unit 1. In this case also, it should be pointed out that the detector 5 is shown only schematically. For this purpose, an optical or electric sensor or the like may be provided. However, in addition, it is also contemplated to provide a length counting device which detects the entered sliver length and which switches off when the sliver length which is normally in a can has almost run off.

The spinning unit 1 is equipped with a plate-shaped supporting device 15 which contains an inlet funnel 16 leading to the sliver feeding device 2. Below the inlet funnel 16, the supporting device 15 is equipped with two webs 17 which are aligned vertically and which form a groove-shaped guide for the sliver 3. In the area of the groove-shaped guide, the supporting device 15 is provided with a recess 14.

In the operating condition according to FIG. 1, the further entering of the sliver 3 is interrupted. The can, from which the sliver 3 was withdrawn, has already been replaced by a can 7 in which a new sliver 9 is located. This new sliver 9, with its starting portion 10, hangs over the upper edge 8 of the can 7. A a servicing device 12, which can be moved in longitudinal direction of the machine, has already been applied to the spinning unit 1 and the can 7, this servicing device 12 being equipped with devices 11 for picking up the starting portion 10 of the new sliver 9. These devices 11 consist of a combination of a suction nozzle and a sliver clamp. The devices 11 can be moved inside the servicing device 12 in such a manner that, after finding the starting portion 10 of the sliver 9 and after this starting portion was clamped in, they move upwards and are applied to the spinning point 1. In this case, the devices 11 are turned such that the starting portion 10 of the new sliver 9 points upwards. Subsequently, this sliver 9 is placed over the old sliver 3 so that the two overlap in the area of the supporting device 15 while they are laterally guided by the webs 17. Also see our application filed on even date titled A SLIVER CONNECTING ARRANGEMENT FOR A SPINNING MACHINE and based upon German application No. P 38 02 414.4, filed in the Federal Republic of Germany on Jan. 28, 1988, corresponding to U.S. application Ser. No. 302,328, filed Jan. 27, 1989.

As also shown in FIG. 1, the servicing device 12 is equipped with a device 18 for cutting the old sliver 3 to the proper length. This device 18 can be moved out in a direction of the Arrows (C and D). This cutting into a proper length takes placed before the new sliver 9 is applied to the old sliver 3. It is therefore possible to precisely determine the overlapping length of both slivers 3, 9. For this purpose, a device for cutting the starting portion 10 of the sliver 9 into the proper length may be provided in a similar manner. For connecting the slivers 3, 9, which are disposed above one another, a pressure rod 13 is moved out of the servicing device 12 which can be moved in the direction of the arrows (A and B). This pressure rod 13 presses the two slivers 3, 9 into the recess 14. In many cases, such a pressing-on will be sufficient for producing a connection by means of which the sliver 9, when the sliver feeding device 2 is restarted, is taken along by the old sliver 3. However, in a modified embodiment, it is provided that the head of the pressure rod 13 is equipped with additional devices by means of which a connection is achieved, such as a glued connection or possibly also a type of sewing-together.

The pressure rod 13 is also moved out when the sliver 3 is cut into the proper length. As a modification of the shown embodiment, instead of a cutting device, a sliver clamp may be provided which grips the sliver 3 which is hanging down and, while it is held in a clamped manner by the pressure rod 13, pull it downward. The distance between the pressure rod 13 and the sliver clamp must then be larger than the average staple length of the fiber material. In a similar manner, the starting portion 10 of the new sliver 9 may also be drawn and made thinner. If then the thus obtained portions of the slivers 3, 9 are connected with one another, it is achieved that this connecting point does not have an excessive fluctuation in count, i.e., it corresponds essentially to the number of fibers in the other areas of the slivers 3, 9. In this case, the connecting point may be utilized; i.e., the fibers which are combed out of the connecting point or are otherwise drawn, may already be reused in the spinning process. However, as a rule, a thick point will be formed in the overlapping area so that the number of fibers is doubled. In a spinning process, this may result in disadvantages. It will therefore be provided in most cases that the sliver feeding device 2, before the spinning is resumed, is switched on until the connecting point has entered into the spinning unit 1. The fibers, which have then entered into the spinning unit 1, are not utilized for the spinning process, but are removed as waste. For this process, it may be provided that the servicing device 12 takes over or controls the switching-on of the fiber feeding during this time period.

In the embodiment according to FIG. 1, it is provided that the devices 11 for picking up the new sliver 9 are not identical with the devices 45 for connecting the slivers 3, 9. However, in other embodiments, these devices may be combined with one another, as shown, for example, in the embodiment according to FIG. 2.

Figure 2:
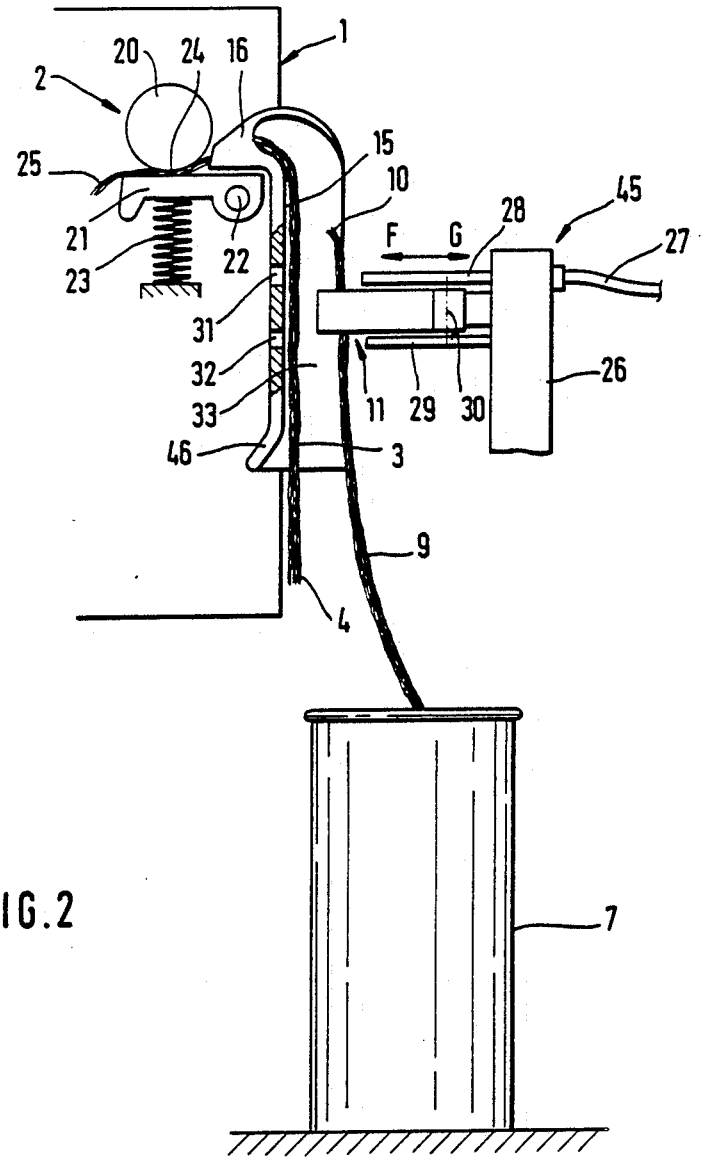
FIG. 2 is a schematic lateral view of a spinning machine and of parts of a servicing device constructed according to a preferred embodiment of the invention during the feeding of the starting portion of a new sliver.

In the embodiment according to FIG. 2, a device 11, which is constructed as a gripping device, has picked up the starting portion 10 of the new sliver 9, has directed it upwards and has then moved into the direction of the supporting device 15 of the spinning unit 1. The devices 11, which are developed as the gripping device, place the starting portion 10 of the new sliver 9 in the area of the supporting device 15, i.e., in the groove formed by webs and a rear wall 46. In this construction, the supporting device 15 is developed in one piece with an inlet funnel 16 which offers the entering sliver 3 to a sliver feeding device 2 consisting of a feeding roller 20 and a work table 21 which, together with it, forms a nipping line 24. The work table 21 can be swivelled around a shaft 22, which is parallel to the feeding roller 20, and this work table 21 is loaded by means of a pressure spring 23 in the direction of the feeding roller 20. The end portion of the sliver 3 is offered to an opening device, which is not shown, in the form of a fiberbeard 25.

After the starting portion 10 of the new sliver 9 is placed, the gripping element of the devices 11 for the picking-up is opened. Connecting elements 28, 29 are then moved out and are guided to the slivers 3, 9 which overlap one another. Openings 31, 32 of the supporting device 15 are opposite the connecting elements 28, 29 constructed as pressing devices. The two slivers 3, 9 are pressed into these openings 31, 32 of the supporting device 15. As a result, the two slivers 9, 3 or their fibers are mixed with one another.

The arm 26 of the combined devices 11, 45 for the picking-up and for the connecting are connected to a compressed-air pipe 27, by means of which the connecting elements 28, 29 can be moved out and can also be retracted again in the direction of the Arrows (F and G). If necessary, an additional compressed-air blow-out device may be provided which is aimed at both slivers 3, 9 and which promotes the mixing of the fibers of the slivers 3, 9.

Figure 3:
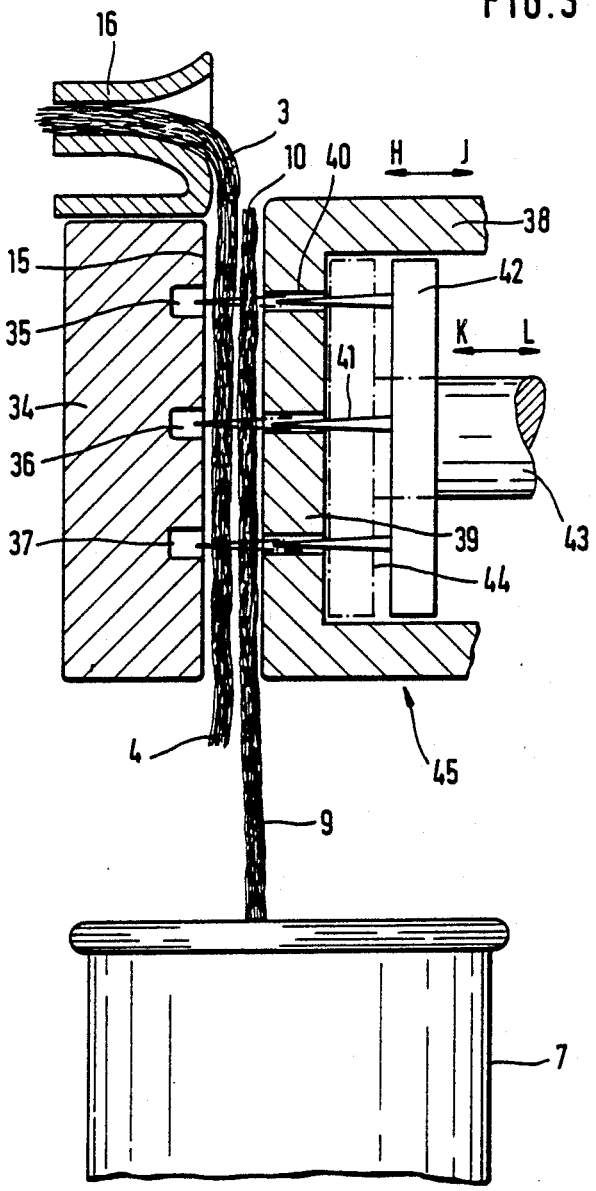
FIG. 3 is a detail of a servicing device and of a spinning unit during the connecting of two slivers using a preferred embodiment of the invention.

FIG. 3 shows another possibility of connecting with one another the two slivers 3, 9 by means of mechanical elements to such an extent that, when the sliver feeding of the feeding device, which is not shown, is restarted, the old sliver 3 takes along the new sliver 9 into the spinning point 1. The new sliver 9 was picked up by devices, which are not shown, at the spinning can 7 and was brought into the area of the spinning point such that the starting portion 10 of the new sliver 19, over a certain length, overlaps with the end portion 4 of the old sliver 3 in an area below the inlet funnel 16. In this area, a supporting element 15A is provided in the form of a plate which is provided with several recesses 35, 36, 37. The two slivers 3, 9, which overlap one another, by means of a flat pressing element 38 of the devices 45 for the connecting, are pressed against the supporting element 15A. Subsequently, needle-type connecting elements 41 are moved out of the pressing element 38, in the direction of the arrow K. Element 38 can be moved in the direction of the arrows (H, J). These connecting elements 41 penetrate the pressing element 38 in bores 40 and are fastened at a plate 42 located at the back of the pressing element 38, this plate 42 being adjustable via a mandrel 43. The needle-shaped connecting elements 41 pierce the two slivers 3, 9 while penetrating into the recesses 35, 36, 37 of the supporting element 15. This causes a mixing of the fibers of the two slivers 3, 9. After this mixing, the needles 41 are retracted in the direction of the Arrow (L), after which the pressing element 38 is also retracted.

Figure 4:
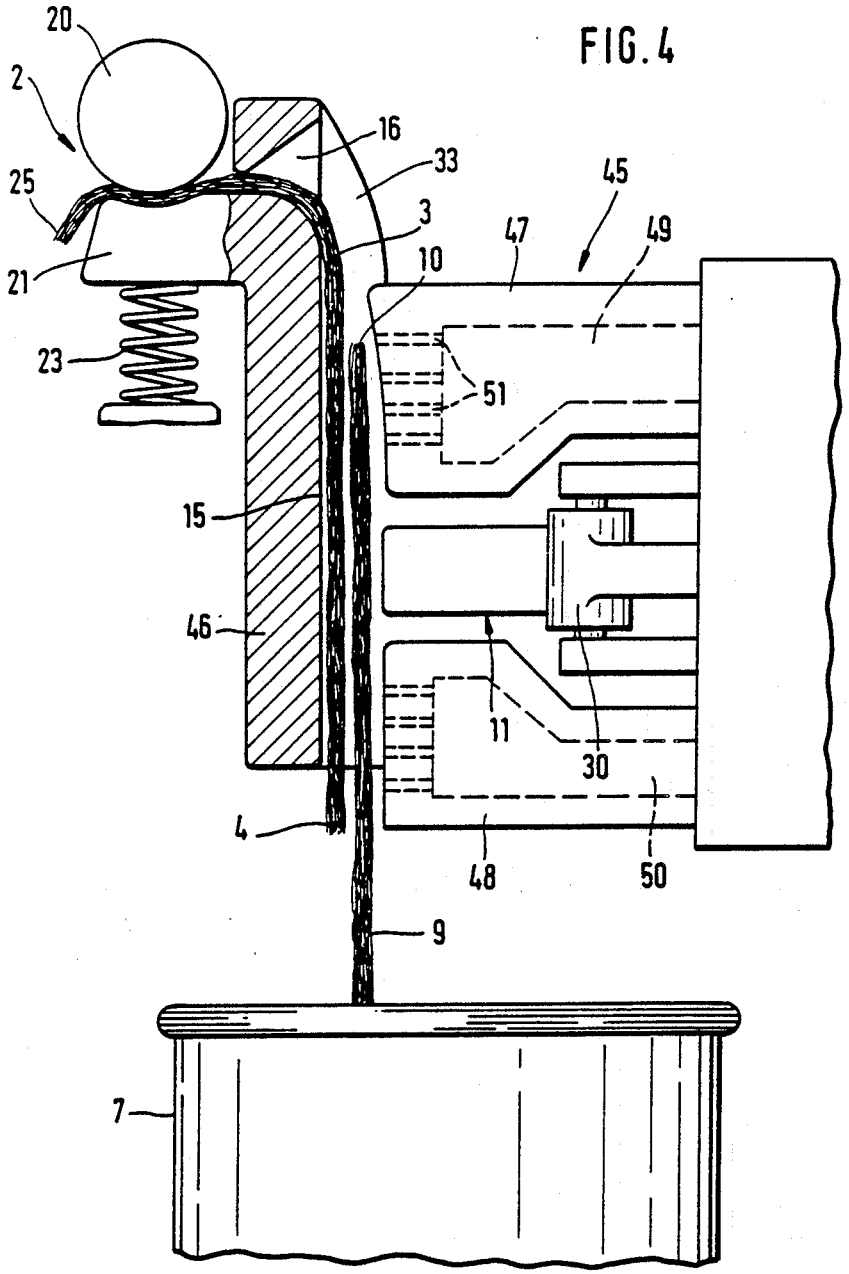
FIG. 4 is a view similar to FIG. 3, showing another embodiment of devices for the connecting of two slivers which are applied to a spinning point.

In the embodiment according to FIG. 4, the devices 11B for the picking-up of the new sliver 9 are again combined into one structural unit with the devices 45 for the connecting of the new sliver 9 with the old sliver 3. In the representation according to FIG. 4, the devices 11B have already released the upward-pointing starting portion 10 of the new sliver 9 which, in the area of a groove formed by a supporting device 15B, lies, in an overlapping manner, on the end portion 4 of the old sliver 3. The supporting device 15B consists of a plate 46 which forms one piece with a feeding table 21 of the feeding device 2, this plate 46, at the exterior side, being provided with longitudinal webs 33 which, starting from an inlet funnel 16, form a groove pointing downward. Above and below the tongs-shaped gripping elements, the tongs-shaped gripping arms of which can be swivelled around a vertical shaft 30, two compressed-air nozzles 47, 48 are located, the interior compressed-air ducts 49, 50 of which, via blow openings 51, are aimed into the groove and at the slivers 3, 9. Via these compressed-air nozzles 47, 48, compressed-air currents are blown out which result in a mixing of the fibers of the slivers 3, 9, i.e., in a kind of splicing. For this process, it may, under certain circumstances, be expedient for the old sliver 3 to be loosened in preparation which may, for example, take place by previously once aiming the compressed-air nozzles 47, 48 at the old sliver 3, before the new sliver 9 is inserted, i.e., before the new sliver 9 is taken up from the can 7.

Figure 5:
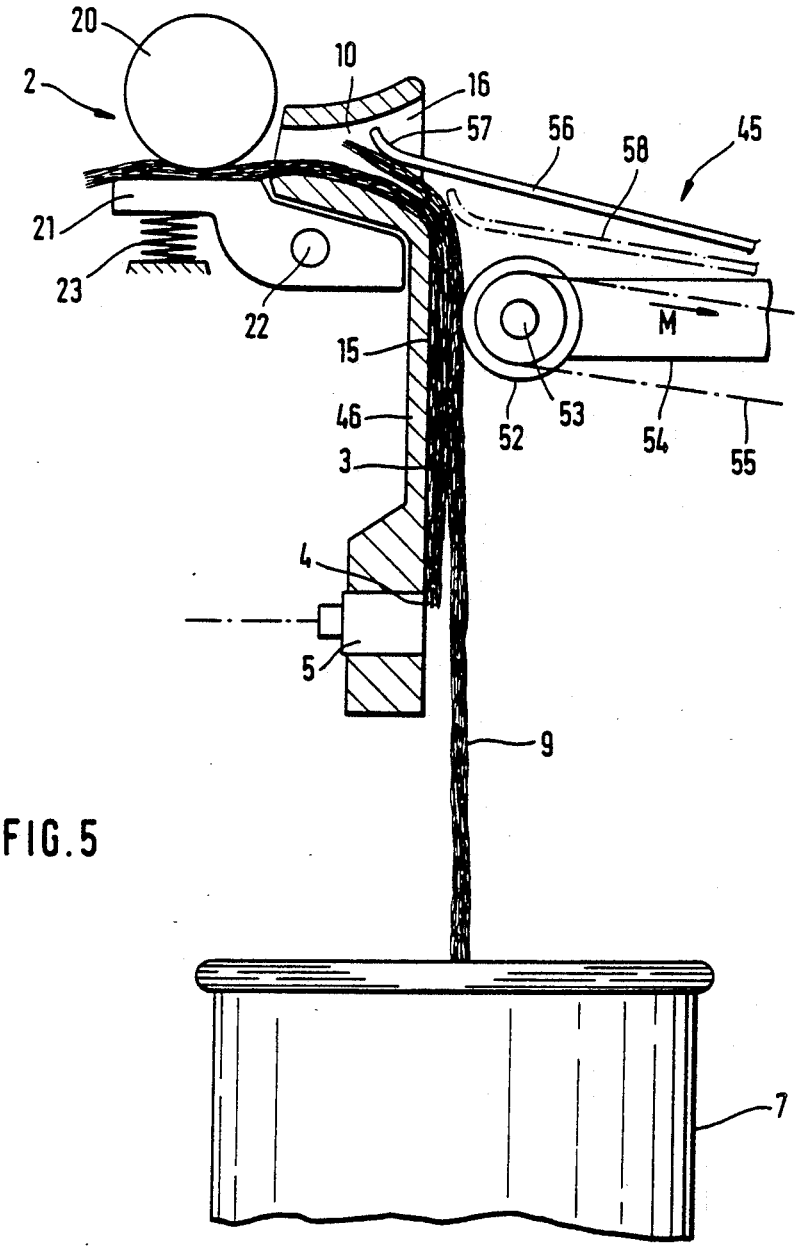
FIG. 5 is a partial view of another embodiment in which devices are provided for the conveying of the new sliver.

In the embodiment according to FIG. 5, additional devices are assigned to the devices 45C for the connecting, these additional devices serving the actual connecting of the two slivers 3, 9. The two slivers 3, 9 may be connected with one another in one of the already explained manners, in which case, for reasons which will be explained in the following, a relatively weak connection is sufficient because between the slivers 3, 9 no signficant tensile force must be transmitted. A frictional wheel 52 is applied to the supporting device 15C which is formed of a plate-shaped component which forms one piece with the inlet funnel 16, this frictional wheel 52 being arranged on an arm 54 which can be applied to the supporting device and can be moved away again in the direction of the Arrow M. The frictional wheel 52 is disposed so that it can be rotated around a shaft 53 and is driven by means of a belt 55. The frictional wheel 52 is driven at a circumferential speed which corresponds approximately to the circumferential speed of the feeding roller 20 of the sliver feeding device 2. The frictional wheel 52 is applied to the new sliver 9 located on the outside and presses it, together with the old sliver 3, against the supporting surface, in which case the sliver 9, as a result of the rotation of the frictional wheel 52, is withdrawn from the can 7. In order to securely introduce the starting portion 10 of the new sliver 9 into the inlet funnel 16, a movable finger 56 is also provided which is applied to the starting Portion 10 of the new sliver 9 above the frictional wheel 52 (position 58), and which moves along with the sliver 9 and, in the process, deflects the starting portion 10 into the inlet funnel 16. The finger 56, which has a slightly bent-away end 57, is moved by means of a crank guide, in a manner which is not shown in detail, between position 58 and position 56. As soon as the starting portion 10 of the new sliver 9 has entered into the feeding device 2, the finger 56 and the frictional wheel 52 may be retracted.

It is also contemplated to provide a blowing nozzle instead of a finger 56, this blowing nozzle generating an air current aimed into the inlet funnel 16.

In a modified embodiment, it is provided that the finger 56 itself is constructed as a conveying device, and in this case, pushes the sliver 9 with the sliver 3 located underneath it in the direction of the sliver feeding device 2. Under certain circumstances, it would be useful in this case for the side facing the slivers 3, 9 to be provided with a coating having an increased friction with respect to the fibers.

Figure 6:
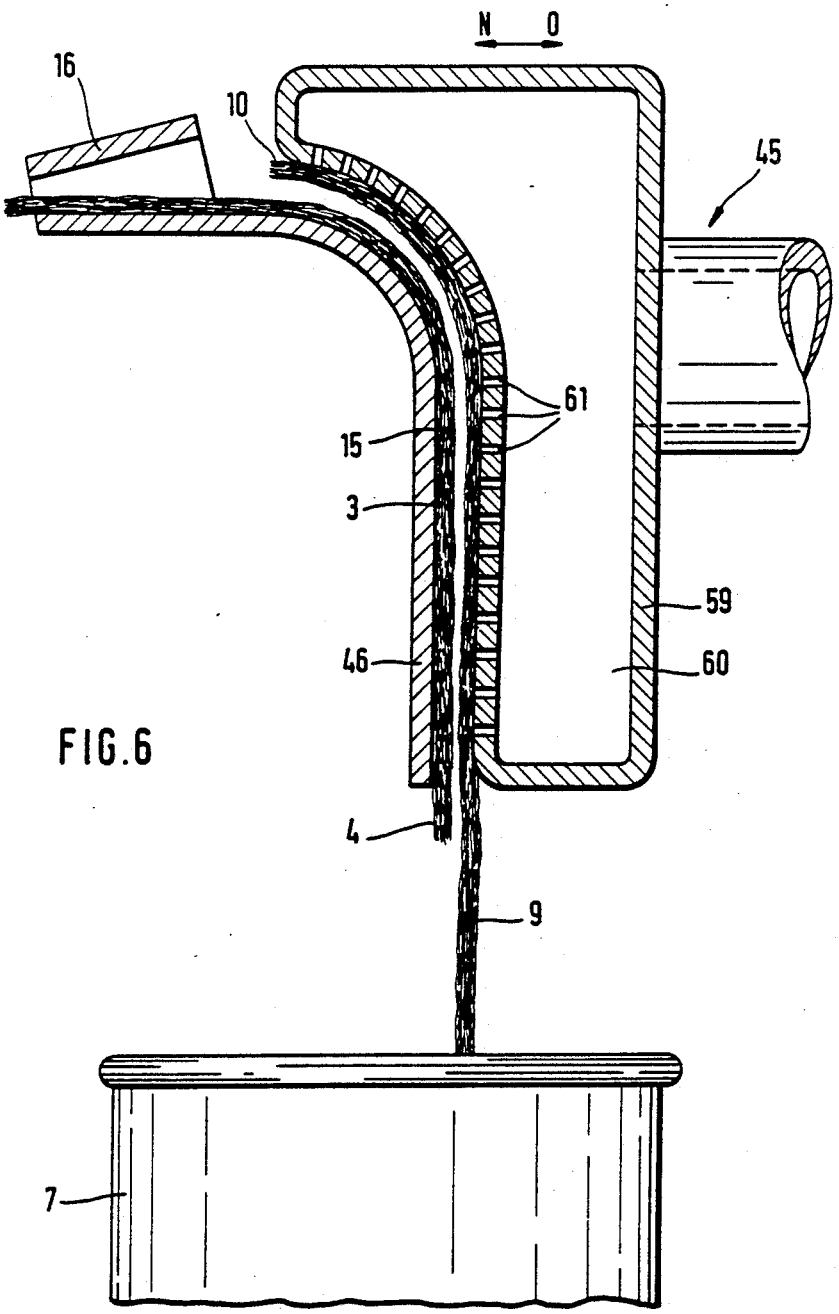
FIG. 6 is a partial view of another embodiment having combined devices for the gripping of the starting portion of a new sliver and for the connecting with the old sliver.

In the embodiment according to FIG. 6, the starting portion 10 of a new sliver 9 and the end portion 4 of the old sliver 3 rest against one another in an overlapping manner while they are supported by a supporting device 15D forming a curved guideway, this suporting device 15 having the shape of a plate 46 which is equipped with an inlet funnel 16D. The device 45 for connecting the two slivers 3, 9 consists of a blowing head 59 having a surface which is curved corresponding to the curvature of the supporting device 15D, this surface having a vertically directed area and an area which is curved into the inlet funnel 16. The interior space 60 of the blowing head 59, via blow bores 61, is open toward the area of the two slivers 3, 9. By means of the blowing-out of compressed air from the blow openings 61, the fibers of the two slivers 3, 9 are mixed with one another and are thus connected with one another. Subsequently, the blowing head 59 is switched off and taken back.

The blowing head 59 according to FIG. 6 may also be constructed as a device for picking up the starting portion 10 of the sliver 9. For this purpose, a reversing valve is provided, which is not shown, by means of which the blowing head 59 is connected to a vacuum pipe so that it then serves as a suction gripper by means of which the starting portion 10 of the new sliver 9, which hangs over the edge of the spinning can 7, is picked up and is applied to the supporting device 15D.

Figure 7:
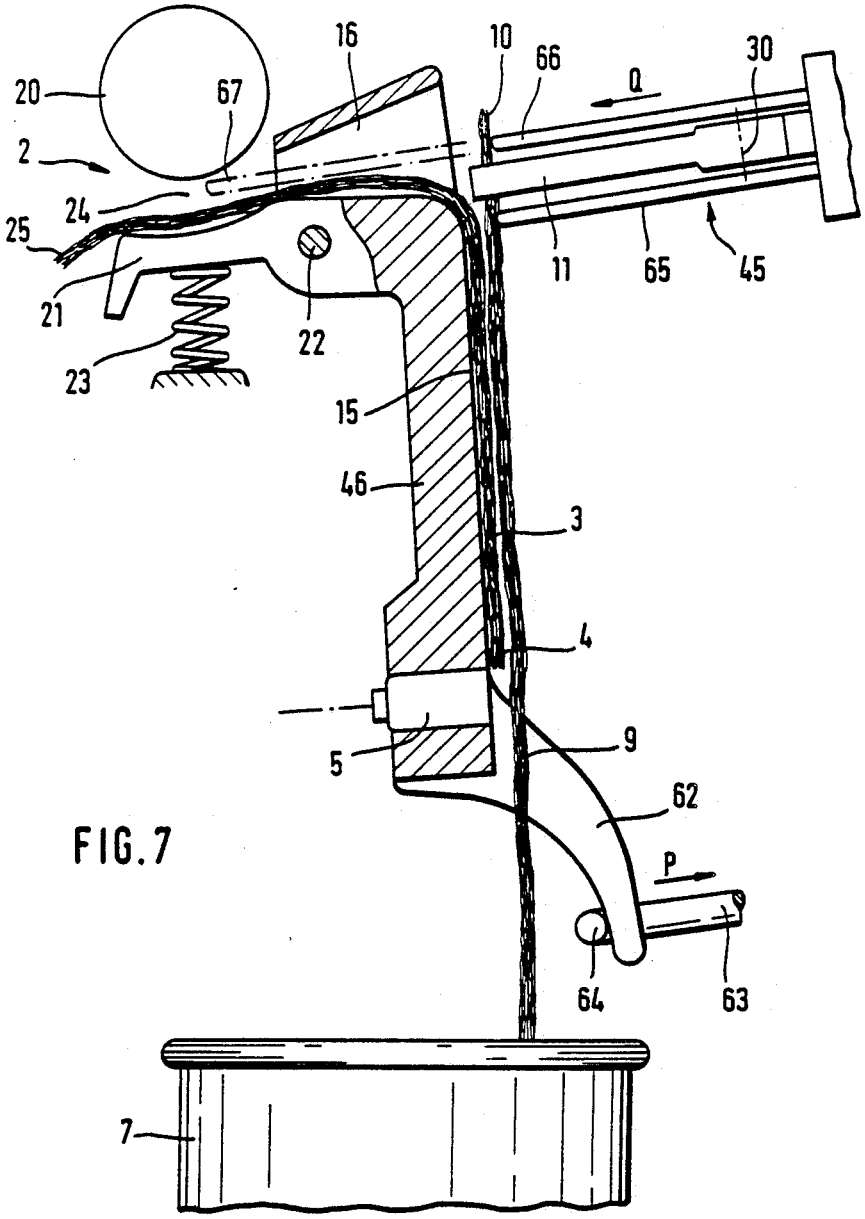
FIG. 7 is a partial view of another embodiment in which the feeding device is opened for the threading-in of a new sliver.

In the embodiment according to FIG. 7, a feeding table 21E of the sliver feeding device 2E is constructed in one piece with the supporting device 15E which has a plate-shaped area which extends essentially vertically and is preferably provided with a guiding groove which is not shown. Thus, the supporting device 15E, together with the feeding table 21E, can be swivelled around a shaft 22 which is parallel to the feeding roller 20. The plate-shaped part is equipped with a gripping finger 62, a connecting rod 63 reaching behind this gripping finger 62 which has a hook-shaped part 64 and which can be moved in the direction of the Arrow (P) by means of a servicing device 12 which is not shown, so that not only the supporting element 15E, but also the feeding table 21E are swivelled. In the embodiment according to FIG. 7, the devices 11E for picking up the starting portion 10 of the new sliver 9 have gripped this starting portion 10 and up to the area of the inlet funnel 16E, have applied it to the spinning point 1 in such a manner that the starting portion 10 of the new sliver 9 overlaps the end portion 4 of the old sliver 3 in the area of the supporting device 15E. Devices 11E are developed as a gripper which has two tong arms which can be swivelled around a shaft 30. Devices 11E are also equipped with the devices 45 for the connecting of the two slivers 3, 9. For this purpose, two fingers 65, 66 are used, which can be applied to the starting portion 10 of the new sliver 9 in the direction of the Arrow Q, the upper finger 66 being movable into position 67, i.e., into the area of the nipping line 24, which, by means of the swivelling-away of the supporting device 15E and of the feeding table 21E, is discontinued during this time period. It is therefore possible to introduce the two slivers 3, 9, i.e., the area of the overlapping, into the area of the nipping line 24. After this has happened, the fingers 65, 66 are retracted. Subsequently, the connecting rod 63 is moved out so that the spring 23 again presses the feeding table 21E toward the feeding roller 20E.

In all shown embodiments, it is provided that the supporting device 15, 15A, 15B, 15C, 15D, and 15E is part of the respective spinning unit 1. This is definitely always necessary when this supporting device 15, 15A, 15B, 15C, 15D, and 15E forms one part with an inlet funnel 16 or a feeding table 21. However, when these parts are separate from the supporting device 15, 15A, 15B, 15C, 15D, and 15E or at least separable, it is also possible to integrate this supporting device 15, 15A, 15B, 15C, 15D, and 15E into the movable servicing device 12 and, when a new sliver 9 is pieced, to apply this supporting device 15 to the respective spinning point 1 in such a manner that it reaches behind the old sliver 3 according to other contemplated embodiments.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A spinning machine having a plurality of adjacently arranged spinning units, each containing a sliver feeding means for the withdrawal of a sliver from a container and for the introduction of the sliver into the respective spinning unit, and having means for picking up the starting portion of a new sliver of a readies container and for connecting it with the end portion of the old sliver entering into the spinning unit, wherein each spinning unit, in the inlet area, is equipped with sliver supporting means for supporting the entering sliver, and wherein the means for picking up the starting portion of the new sliver is applied to the sliver supporting means in such a manner that the old sliver and the new sliver overlap one another and are clamped at their overlapped portion between the sliver supporting means at the spinning unit and a clamping means of the means for picking up the starter portion of the sliver.

2. A spinning machine according to claim 1, wherein the sliver supporting means are constructed as a guiding groove arranged blow an inlet for the sliver.

3. A spinning machine according to claim 2, wherein the means for the connecting contain at least one blowing nozzle which can be aimed at the slivers.

4. A spinning machine according to claim 1, wherein the means for connecting the old sliver with the new sliver can be applied to the sliver supporting means.

5. A spinning machine according to claim 1, wherein the means for the picking-up and for the connecting contain at least one means for cutting at least one of the old and the new sliver to the proper length.

6. A spinning machine according to claim 5, wherein at least one of the means for the picking-up, the means for the cutting into the proper length, and the means for the introduction, are housed in a movable servicing means which can be applied to the individual spinning units.

7. A spinning machine according to claim 1, wherein means are provided for preparing the end portion of the old sliver and the starting portion of the new sliver.

8. A spinning machine according to claim 1, wherein the means for the connecting contain elements for the mixing of the fibers of both slivers.

9. A spinning machine according to claim 8, wherein the means for the connecting contain needle-shaped elements which are pierced into the slivers.

10. A spinning machine according to claim 8, wherein the elements for the mixing contain at least one blowing nozzle which can be aimed at the slivers.

11. A spinning machine according to one of claim 1, wherein means are provided which is applied to the sliver feeding means for introducing the starting portion of the new sliver into the inlet of the respective spinning unit.

12. A spinning machine according to claim 1, wherein the means for the picking-up and the means for the connecting contain at least one element for the conveying of sliver.

13. A spinning machine according to one of claim 1, wherein the sliver supporting means are movably held at the spinning unit and are connected with a means for the opening of the sliver feeding means, and wherein a movable servicing means is provided which is equipped with means for moving the sliver supporting means.

14. A spinning machine according to one of claim 1, wherein a movable servicing means is provided which is equipped with means for the opening and exposing of the sliver feeding means.

15. A spinning machine according to one of claim 14, wherein means are provided which can be applied to the sliver feeding means for introducing the starting portion of the new sliver into the inlet area of the respective spinning unit.

16. A spinning machine according to one of claim 1, wherein a servicing means is provided which is equipped with means for the actuating of the sliver feeding means of a spinning unit.

17. A spinning machine according to claim 1, wherein means are provided for preparing the end portion of the old sliver and the starting portion of the new sliver.

18. A spinning machine according to claim 17, wherein the means for the connecting contain elements for the mixing of the fibers of both slivers.

19. A spinning machine comprising a plurality of adjacently arranged spinning units, each spinning unit including sliver feeding means for withdrawing sliver from a container and feeding the sliver into the respective spinning unit, each spinning unit being provided with sliver supporting surface means for supporting the sliver being fed thereto, and a mobile servicing apparatus which is movably selectively disposable adjacent respective ones of the spinning units to perform servicing operations, said mobile servicing apparatus including sliver splicing means for splicing a starting portion of new sliver from a container with an end portion of old sliver being fed to a respective spinning units wherein said sliver splicing means includes sliver clamp means for clamping overlapping portions of the new and old sliver between said sliver clamp means and the sliver supporting surface means at a respective spinning unit.

20. A spinning machine according to claim 19, wherein the sliver supporting surface means is constructed as a guiding groove arranged below an inlet for the sliver.

21. A spinning machine according to claim 19, wherein the sliver splicing means includes cutting means for cutting at least one of the old and new sliver portions to a proper length.

22. A spinning machine according to claim 21, wherein the sliver splicing means includes sliver end preparing means for preparing at least one of the old and new sliver end portions to facilitate splicing thereof.

23. A spinning machine according to claim 22, wherein the sliver splicing means includes mixing means for mixing fibers from both the old and new sliver portions with one another.

24. A spinning machine according to claim 19, wherein the sliver splicing means includes sliver end preparing means for preparing at least one of the old and new sliver end portions to facilitate splicing thereof.

25. A spinning machine according to claim 19, wherein the sliver splicing means includes mixing means for mixing fibers from both the old and new sliver portions with one another.

26. A spinning machine according to claim 19, wherein the sliver splicing means includes needle-shaped elements which can be pierced into the overlapping sliver portions.

27. A spinning machine according to claim 19, wherein the sliver splicing means includes blowing nozzle means which can be aimed at the overlapping sliver portions.

28. A spinning machine according to claim 19, wherein the mobile servicing apparatus includes means for controlling sliver feeding means at respective spinning units.

* * * * *